US010029495B2

(12) United States Patent
Abe et al.

(10) Patent No.: US 10,029,495 B2
(45) Date of Patent: Jul. 24, 2018

(54) CARRIAGE APPARATUS

(71) Applicant: CANON FINETECH NISCA INC., Misato-shi (JP)

(72) Inventors: Kenichi Abe, Kamakura (JP); Takeshi Sasaki, Tsukuba (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/405,642

(22) Filed: Jan. 13, 2017

(65) Prior Publication Data

US 2017/0210152 A1 Jul. 27, 2017

(30) Foreign Application Priority Data

Jan. 21, 2016 (JP) ..... 2016-010176

(51) Int. Cl.
*B41J 25/00* (2006.01)

(52) U.S. Cl.
CPC ..... *B41J 25/001* (2013.01)

(58) Field of Classification Search
CPC ..... B41J 25/001; B41J 25/308; B41J 19/00; B41J 13/02; B41J 13/03; B41J 13/036; B41J 13/10; B41J 13/22; B41J 13/28; B41J 13/32
USPC ..... 347/37
See application file for complete search history.

(56) References Cited

U.S. PATENT DOCUMENTS 4,636,844 A 1/1987 Sasaki
4,639,747 A 1/1987 Sakurada et al.
4,682,186 A 7/1987 Sasaki et al.
4,682,216 A 7/1987 Sasaki et al.
4,714,964 A 12/1987 Sasaki
4,731,662 A 3/1988 Udagawa et al.
5,764,250 A 6/1998 Tenenbaum et al.
5,987,186 A * 11/1999 Oida ..... H04N 1/4076 358/445
6,055,068 A 4/2000 Abe et al.
6,250,731 B1 6/2001 Hashimoto
6,471,325 B2 10/2002 Abe
6,529,225 B1 3/2003 Shiraiwa et al.
6,867,879 B1 3/2005 Sasaki et al.
6,891,556 B2 5/2005 Sasaki et al.
8,727,468 B2 5/2014 Iwakura
8,764,182 B2 7/2014 Ogawa et al.
9,545,804 B2 1/2017 Iwakura
(Continued)

FOREIGN PATENT DOCUMENTS

JP H02-032882 A 2/1990
JP 05-012212 A 1/1993
(Continued)

OTHER PUBLICATIONS

Office Action dated May 29, 2018, in Japanese Patent Application No. 2016-010176.

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

A carriage guide surface for guiding a carriage traveling in a main scan direction, and a main scan direction regulating unit and a sub-scan direction regulating unit which position a print medium, are provided on the same member.

8 Claims, 9 Drawing Sheets

(56) References Cited

U.S. PATENT DOCUMENTS

| | | | | |
|---|---|---|---|---|
| 2003/0234852 | A1* | 12/2003 | Oshima | B41J 3/4071<br>347/104 |
| 2004/0246284 | A1* | 12/2004 | Murai | B41J 19/202<br>347/8 |
| 2006/0127156 | A1* | 6/2006 | Takahashi | B41J 19/04<br>400/303 |
| 2012/0140010 | A1* | 6/2012 | Ogawa | B26D 1/045<br>347/104 |
| 2012/0306967 | A1* | 12/2012 | Shimizu | B41J 25/34<br>347/39 |

FOREIGN PATENT DOCUMENTS

| | | | |
|---|---|---|---|
| JP | 05-262434 | A | 10/1993 |
| JP | 06-047966 | A | 2/1994 |
| JP | 06-081055 | U | 11/1994 |
| JP | 08-001377 | A | 1/1996 |
| JP | 08-002041 | A | 1/1996 |
| JP | H10-016350 | A | 1/1998 |
| JP | 2000-141791 | A | 5/2000 |
| JP | 2001-030543 | A | 2/2001 |
| JP | 2009-298077 | A | 12/2009 |
| JP | 2010-107232 | A | 5/2010 |
| JP | 2012-011630 | A | 1/2012 |
| JP | 2012-116122 | A | 6/2012 |

* cited by examiner

CARRIAGE APPARATUS

BACKGROUND OF THE INVENTION

Field of the Invention

The present invention relates to a carriage apparatus performing predetermined processing to a medium disposed at a predetermined position while performing scanning.

Description of the Related Art

There has been known a printing apparatus performing printing and a reading apparatus reading an image to a positioned sheet, while travelling in a main scan direction. The apparatus performs each processing to a medium, while a head to perform printing and reading travels using a shaft, which is provided to extend in the main scan direction, as a guide. In performing the processing, it is important to consider a relative misalignment between the apparatus performing the processing and the sheet.

Japanese Patent Laid-open No. 2010-107232 discloses a printer, which detects the misalignment of a sheet by providing a detecting unit for a carriage, and corrects an image to be printed based on the detection result, thereby improving an accuracy of the image.

However, Japanese Patent Laid-open No. 2010-107232 discloses that a sensor to read the sheet is provided for the carriage, which complicates a configuration and control of the printer and further increases the cost of the printer due to an addition of a component.

SUMMARY OF THE INVENTION

According to a carriage apparatus of the present invention, the carriage apparatus is capable of mounting a processing unit, which is configured to perform predetermined processing to a sheet, on a carriage capable of reciprocating in a predetermined direction, wherein a positioning unit, which is configured to determine a sheet position with respect to the carriage apparatus, and a guide unit, which is configured to guide travel of the carriage in the predetermined direction, are made using the same member.

Further features of the present invention will become apparent from the following description of exemplary embodiments (with reference to the attached drawings).

DESCRIPTION OF THE EMBODIMENTS

First Embodiment

A first embodiment of the present invention will be described with reference to the attached drawings. The embodiments described below are examples as means for achieving the present invention. Corrections or modifications may be made as appropriate without departing from the spirit of the present invention in accordance with the configuration or various conditions of an apparatus to which the present invention is applied. The present invention may not be limited to the following embodiments. In the present embodiment, a description will be given of a printing apparatus in which a print unit is mounted on a carriage, but a carriage apparatus in which a different processing unit is mounted on the carriage may be possible.

Figure 1:
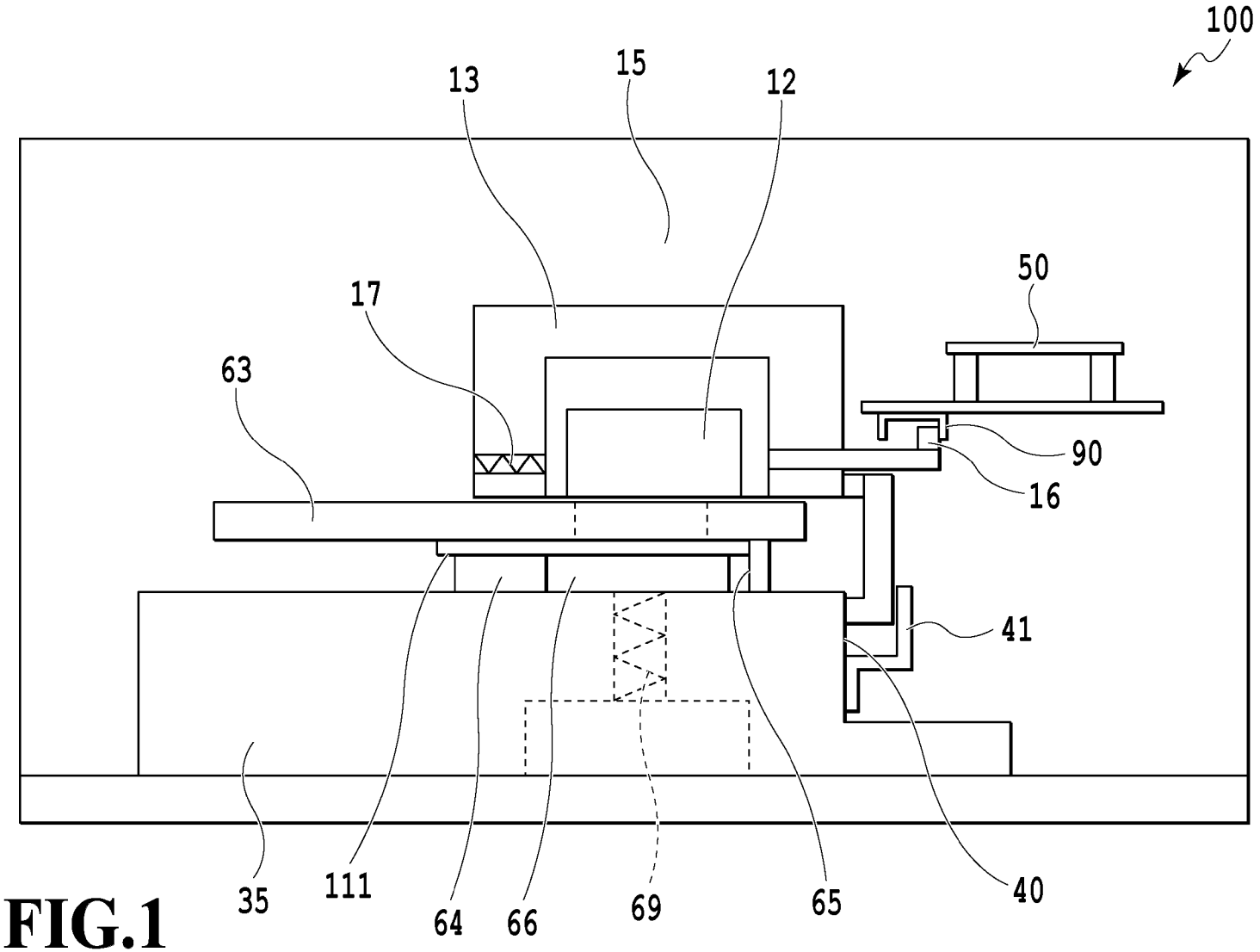
FIG. 1 is a cross-sectional view illustrating an outline structure of a printing apparatus.
Figure 2:
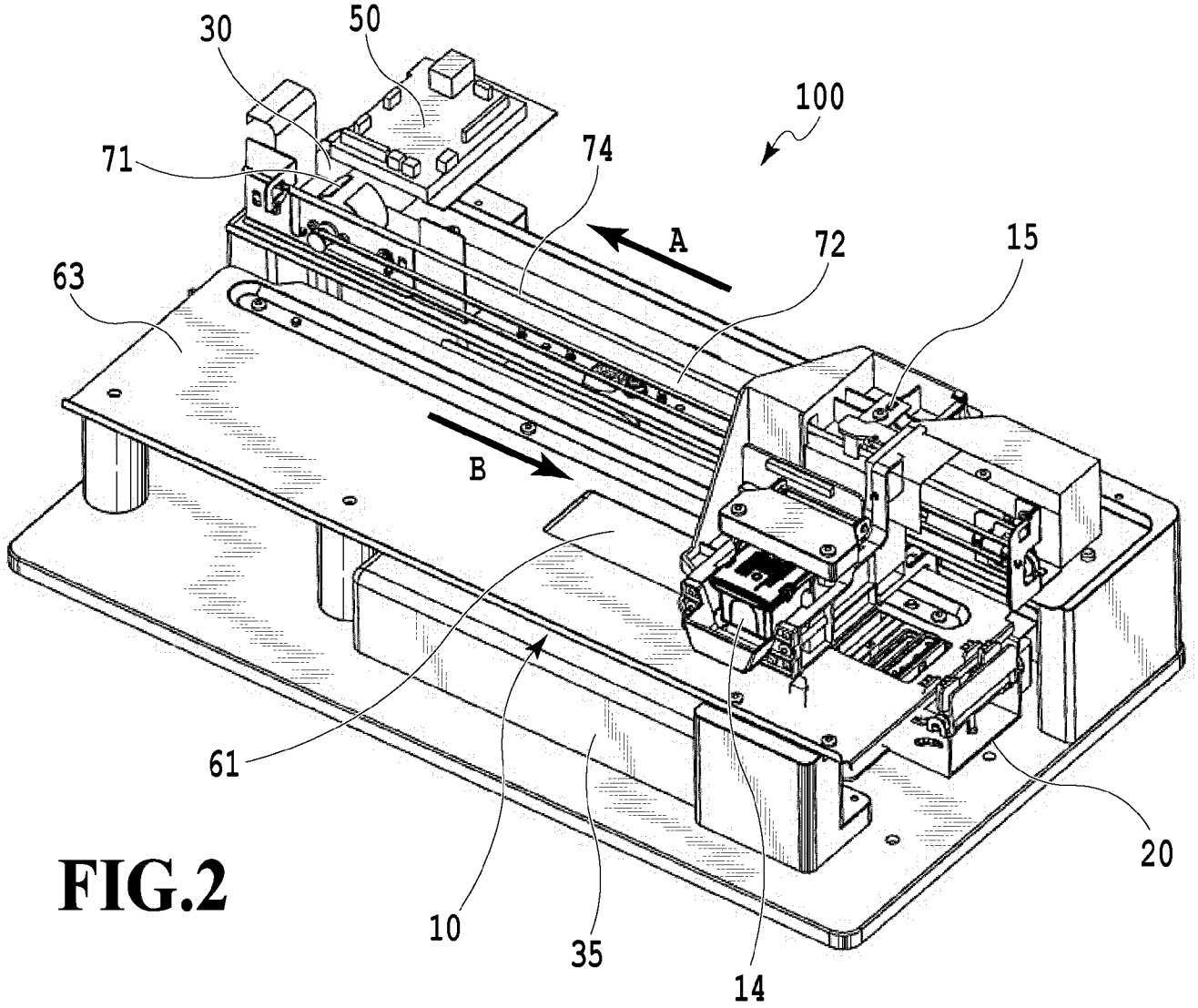
FIG. 2 is a perspective view illustrating the printing apparatus.

FIG. 1 is a cross-sectional view illustrating an outline structure of a printing apparatus 100, and FIG. 2 is a perspective view illustrating the printing apparatus 100 of the present embodiment. The printing apparatus 100 according to the present embodiment mounts a print head thereon, and performs printing on a medium (hereinafter, referred to as "print medium") by scanning the print head. Hereinafter, components regarding main operations of the printing apparatus 100 will be described.

The printing apparatus 100 includes a mounting unit 61 mounting a print medium 111 that is being printed, a lifter unit 10 pressing and retaining the print medium 111 such that the print medium 111 does not travel during the printing, a print head 12 ejecting liquid from an ejection port during the printing, and a head holder 13 retaining the print head 12. Further, the printing apparatus 100 includes a head unit 14 having the print head 12 and the head holder 13 as a unit, a carriage unit 15 capable of mounting the head unit 14, and a purge unit 20 having a cleaning mechanism for the print head 12 and a capping mechanism on standby. Moreover, the printing apparatus 100 includes a carriage drive unit 30 allowing the carriage unit 15 to travel in a predetermined direction, and a carriage guide member 35 guiding the carriage unit 15 during scanning. Moreover, the printing apparatus 100 includes the mounting unit 61 mounting a medium that is being printed, and a carriage guide surface 40 adjacent to the mounting unit 61 for the print medium 111, and the carriage guide surface 40 allows a portion of the carriage unit 15 to contact therewith to be guided to a travel path while regulating a position in a sub-scan direction at the time of setting a print medium. Moreover, the printing apparatus 100 includes a main body control unit 50 controlling operations of each function unit.

Hereinafter, each function unit will be described in detail.

(Print Medium Supply Unit)

In the present embodiment, the print medium 111 is manually supplied to the printing apparatus 100 by a user. The print medium 111 is mounted on the mounting unit 61 before the start of printing operations. The mounting unit 61 can travel between a setting position and a position, at which printing can be performed, in a vertical direction with respect to a print surface of the print medium 111 at the time of printing via a handle lever manually operated by the user and a biasing unit. Incidentally, the handle lever is provided with an angle detention unit, which detects an operational angle of the handle lever to determine a position of the mounting unit 61. The apparatus main body includes a print medium presence/absence detection unit making contact with a portion of the print medium 111 in a state in which the mounting unit 61 can perform printing. The print medium presence/absence detection unit can detect presence/absence of the print medium. Incidentally, in the present embodiment, the presence/absence of the print medium is detected by a detection flag component, but may be detected by a different method, for example, using a sensor and the like. Further, any position of the print medium 111 may be detected.

Figure 3:
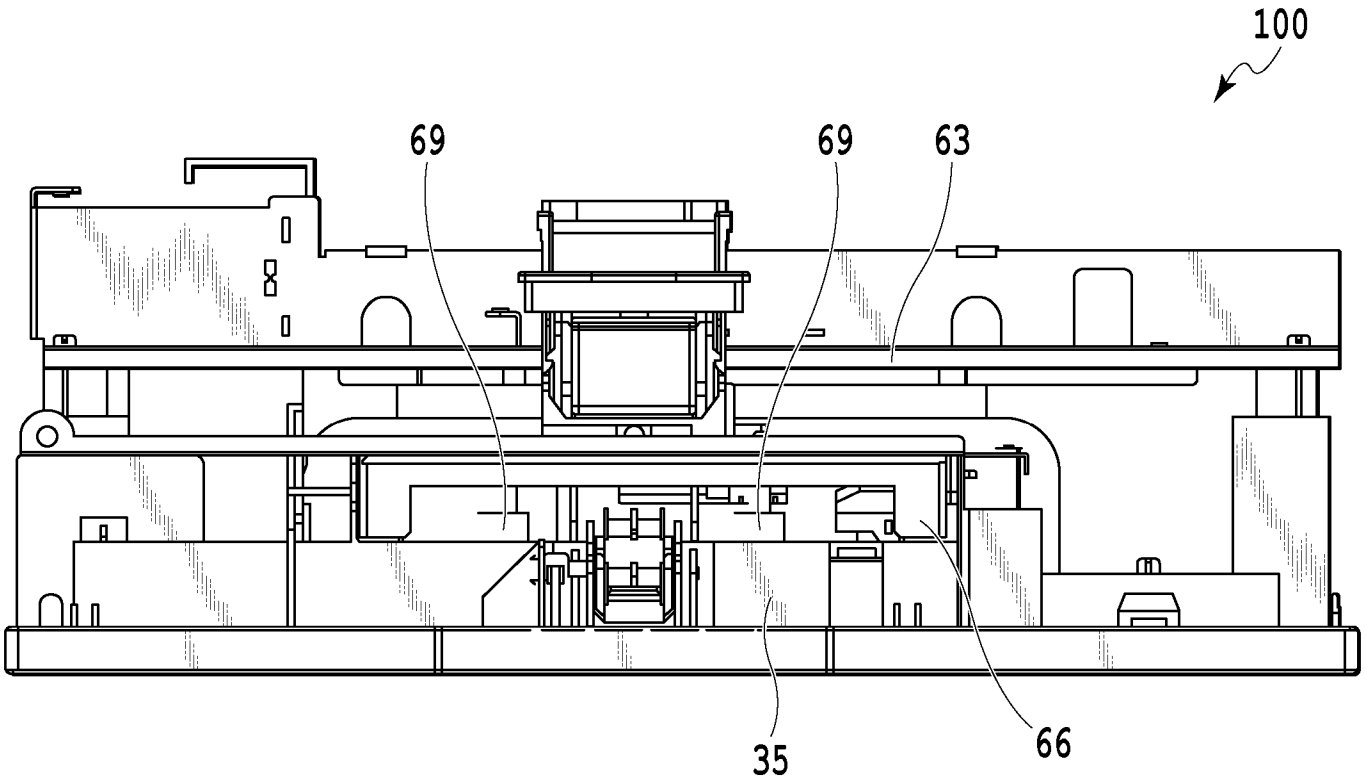
FIG. 3 is a side view illustrating a print medium supply unit.
Figure 4:
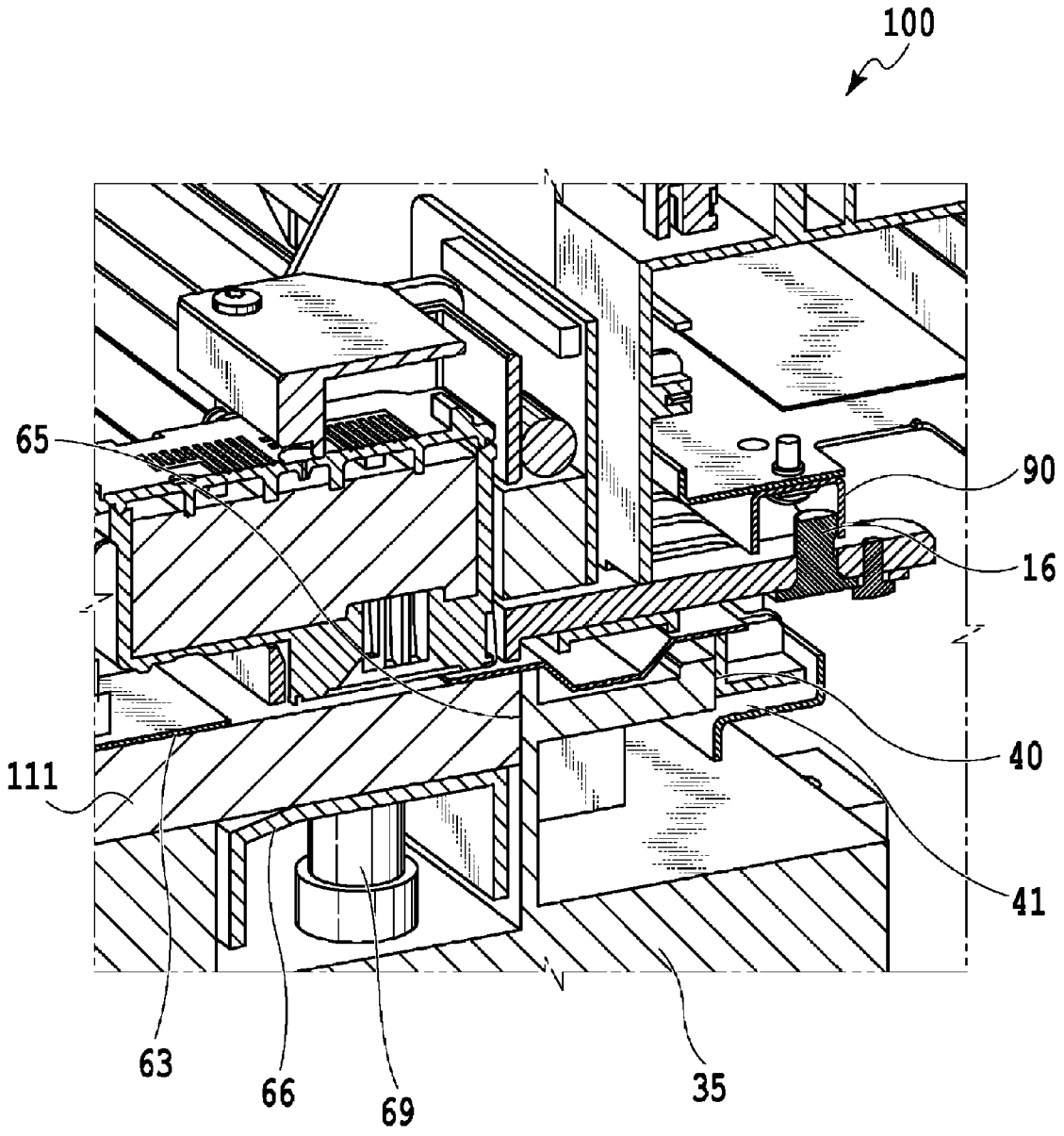
FIG. 4 is a cross-sectional view illustrating a positional relationship between a carriage guide member and a carriage unit.

FIG. 3 is a side view illustrating a print medium supply unit, and FIG. 4 is a cross-sectional view illustrating a positional relationship among the carriage guide member 35, the carriage unit 15, and the print medium 111. In mounting the print medium 111 on the mounting unit 61, the carriage guide member 35 is provided with a position regulating unit regulating a position of an end portion of the print medium 111 in a main scan direction and in a sub-scan direction (intersecting the main scan direction). A main scan direction regulating unit 64 (see FIG. 1) regulates the position of the end portion of the print medium 111 in the main scan direction of the position regulating unit, and a sub-scan direction regulating unit 65 regulates the position of the end portion of the print medium 111 in the sub-scan direction of the position regulating unit. The main scan direction regulating unit and the sub-scan direction regulating unit 65 are provided in the carriage guide member 35 as the same member.

The print medium supply unit is provided with a base plate unit 66, by which the print medium 111 can be pressed against a base plate member 63 in contact upward in a vertical direction, via a lifer base biasing member 69. The print medium 111 is pressed against the base plate member 63 at a constant pressing force by the base plate unit 66, regardless of the thickness of the print medium 111. The print medium 111 that is being printed is pressed and fixed by the print medium fixing unit. As the print medium 111 is pressed and fixed in this manner, a constant distance between the print head 12 and the print medium 111 can be maintained.

In the present embodiment, the print medium 111 is manually supplied by a user, but can be automatically supplied by an automatic supply apparatus. In either case, it becomes possible to suppress a misalignment of the print medium 111 by setting a supply direction of the print medium 111 as a direction in which the print medium 111 is pressed against both of the main scan direction regulating unit 64 and the sub-scan direction regulating unit 65.

In a case where a user sets the print medium 111, a control unit recognizes a state on standby based on the detection results of the angle detention unit and the print medium presence/absence detection unit, and prepares the next operation.

(Purge Unit)

Figure 5:
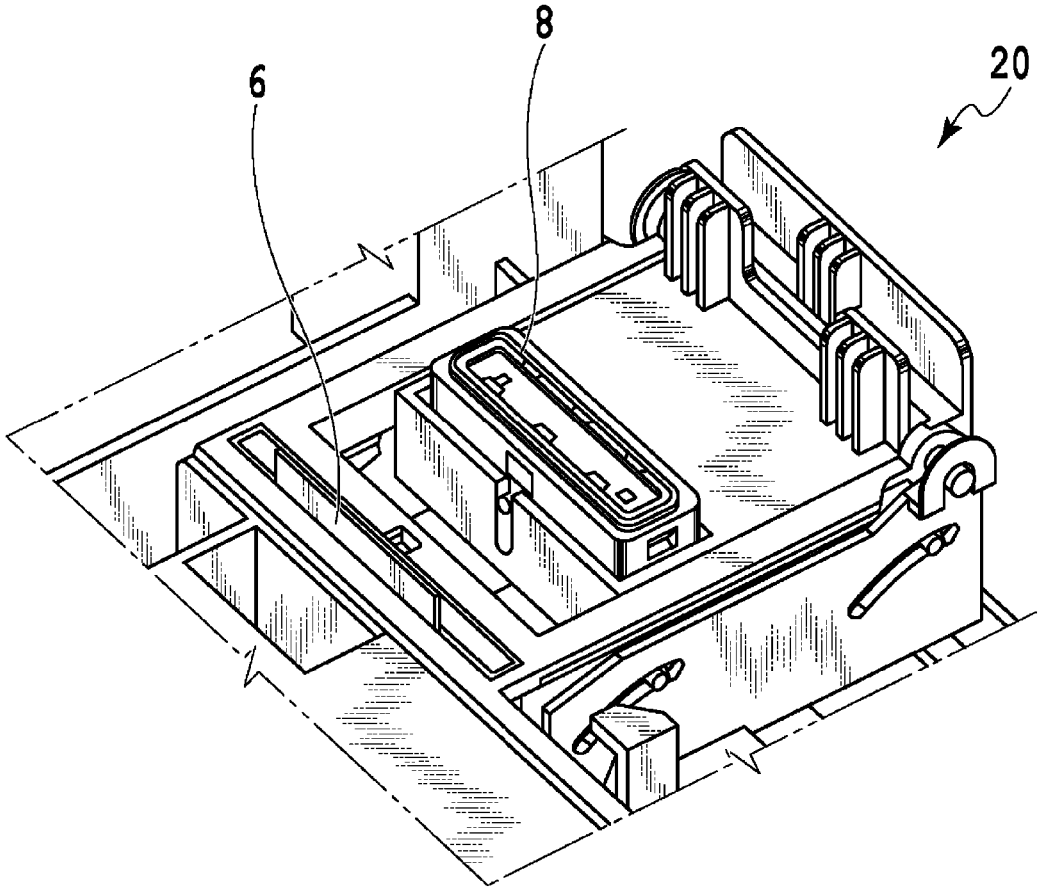
FIG. 5 is a perspective view illustrating a purge unit.

FIG. 5 is a perspective view illustrating a purge unit 20. The purge unit 20 includes a cleaning mechanism and a capping mechanism on standby, and a cap 8 of the capping mechanism caps a formation surface of the ejection port on standby in order to prevent liquid from being evaporated at the ejection port of the print head 12. The purge unit 20 also includes a cleaning unit for the formation surface of the ejection port of the print head 12, which wipes off attached liquid (hereinafter, referred to as ink) by allowing a cleaning blade 6 to contact with the formation surface of the ejection port of the print head 12 in the course of travelling to a standby position. Further, the purging unit 20 drives a pump, which is connected to the cap 8, to decrease pressure in the cap in a capped state, thereby sucking and discharging ink in the ejection port.

(Carriage Drive Unit)

A carriage drive unit includes a motor 71 (see FIG. 2) as a drive force of the carriage unit 15 and a drive belt 72 for transmission of this drive force, and reciprocates the print head 12 in a main scan direction in conjunction with the carriage unit 15. In the present embodiment, the motor 71 uses a DC motor, but may use any motor such as a stepping motor as long as it can transmit the drive source to the drive belt 72. The print head 12 retained in the carriage unit 15 is integrally configured as a cartridge having a liquid ejection unit and an ink tank, and is attached to a head holder 13 with a gap enough to travel in a width direction to configure the head unit 14.

Figure 6:
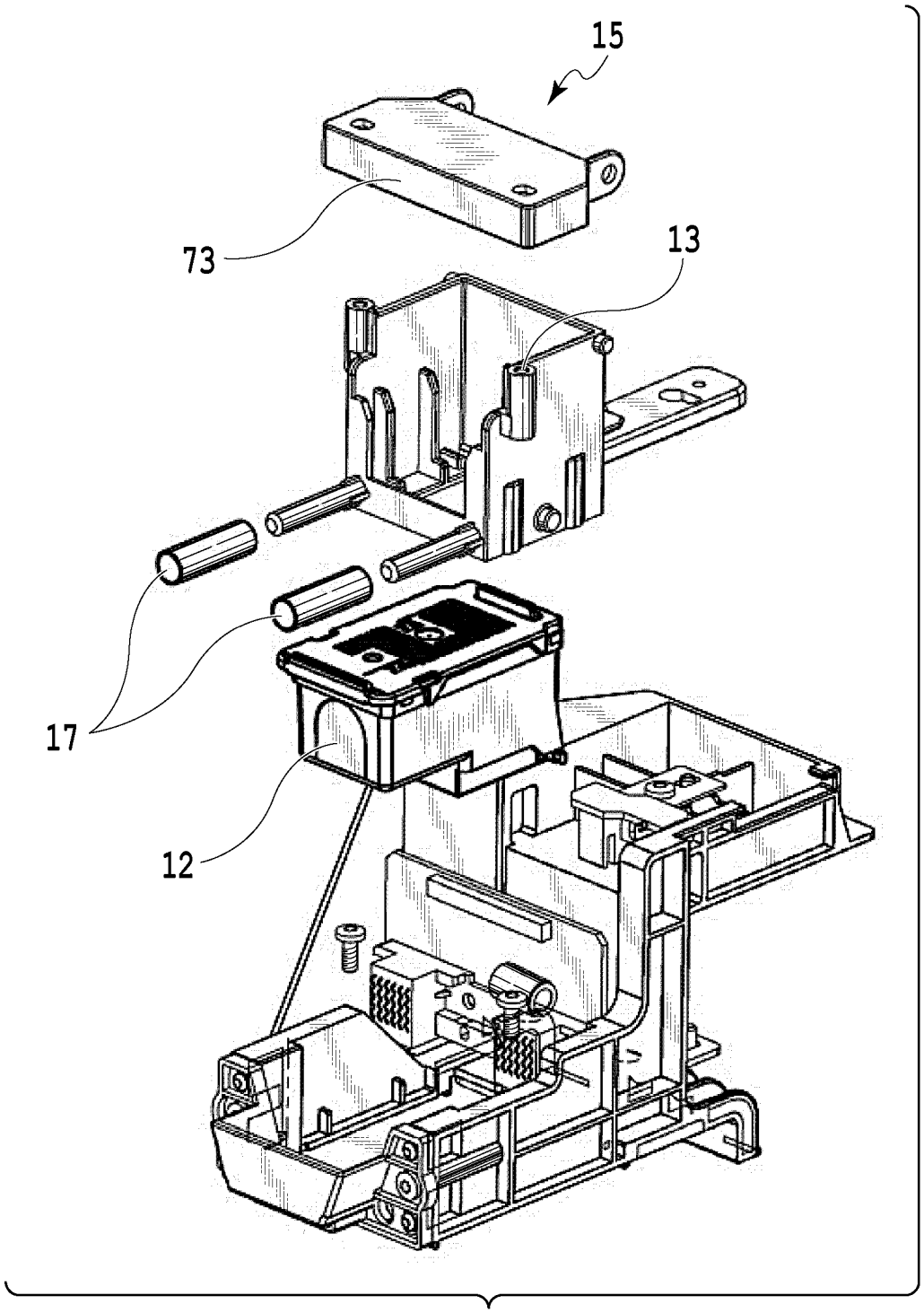
FIG. 6 is an exploded perspective view illustrating the carriage unit.
Figure 7:
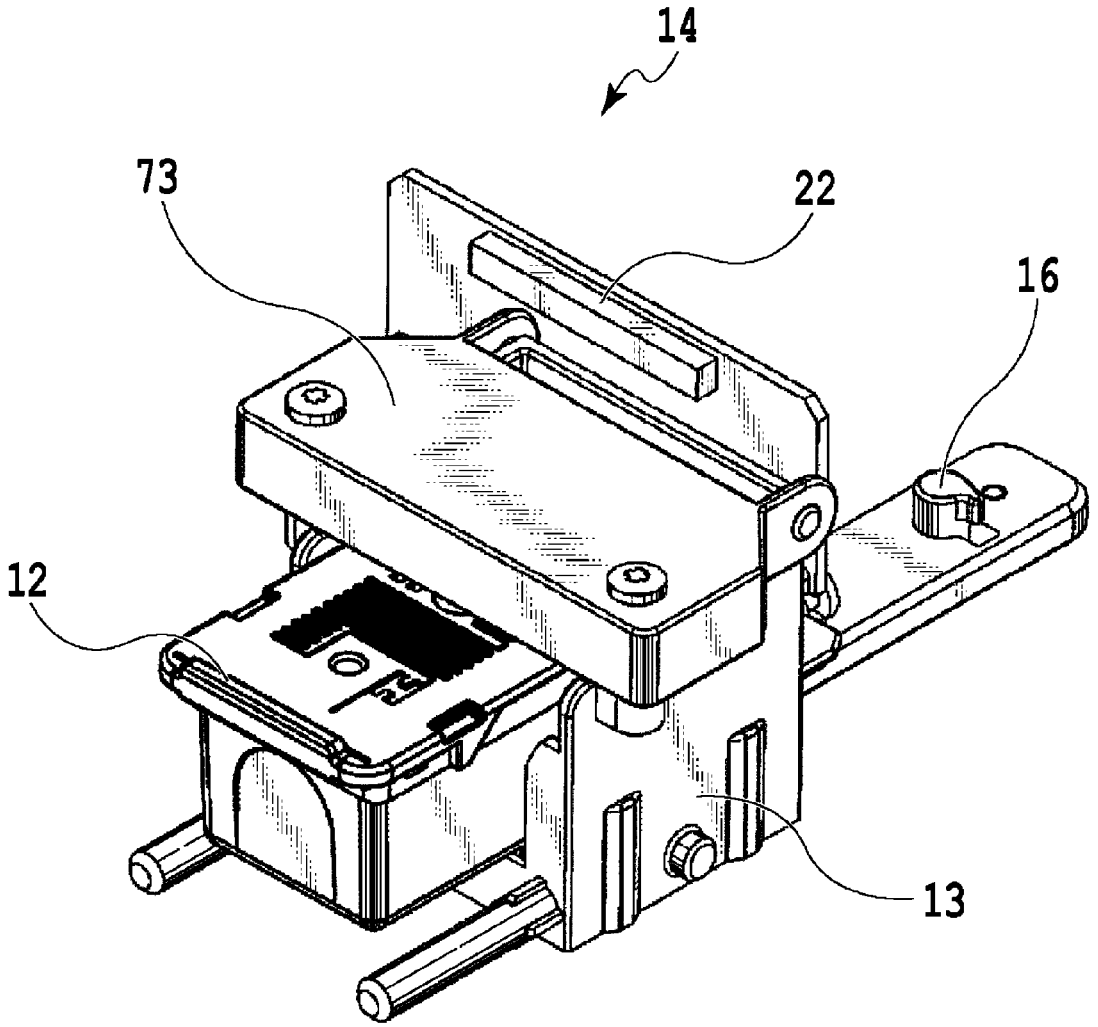
FIG. 7 is a perspective view illustrating a head unit structure.

FIG. 6 is an exploded perspective view illustrating the carriage unit 15 and FIG. 7 is a perspective view illustrating a head unit structure. The head unit 14 travels in the main scan direction by a belt drive while being retained in the carriage unit 15. The head holder 13 includes a cartridge control board 22 making contact with a conduction unit provided in the print head 12, thereby receiving and transmitting an electric signal, and transmits the attachment state of the cartridge and the like to the control unit via a conduction member. Further, the head holder 13 includes a rotatable support unit and retains the print head 12 using a holding member 73 capable of performing pressing and retaining, in order to stabilize the posture of the print head 12 during a printing operation. In the present embodiment, the print head 12 is pressed by fastening the holding member 73 with a screw, but it may be pressed by, for example, a nail shaped member engaging with the head holder 13, and a biasing member.

(Carriage Apparatus Including Carriage Guide Member)

Next, a carriage path guide of the carriage apparatus in the first embodiment of the present invention will be described. In reciprocating the carriage unit 15, the apparatus main body includes the carriage guide surface (see FIG. 4) in a portion of the carriage guide member for guiding a scan path, and the carriage unit 15 travels in the main scan direction while making contact with the carriage guide surface 40. That is, as described above, the carriage guide member 35 includes the carriage guide surface 40 guiding a scan path of the carriage in the main scan direction, the main scan direction regulating unit 64 (see FIG. 1) regulating the print medium 111 in the main scan direction, and the sub-scan direction regulating unit 65 (see FIG. 1) regulating the print medium 111 in the sub-scan direction.

Thus, the main scan direction regulating unit 64 and the sub-scan direction regulating unit 65 to regulate the position of the print medium 111, and the carriage guide surface 40 to guide the carriage unit 15 during travelling are provided on the same member. Accordingly, an assemblage error and the like can be minimalized, and the misalignment of the carriage with respect to the position of the print medium 111 in performing the scanning can also be minimalized. Further, a carriage inclination correction member 41, which minimalizes an inclination of the carriage unit 15 during scanning, is provided on the carriage guide surface 40. As described above, the carriage guide surface 40, the main scan direction regulating unit 64, and the sub-scan direction regulating unit 65 are provided on the same member, thereby decreasing an error of a printing position with respect to the print medium 111 at a minimum level. Therefore, the resultant printing position to be output to the print medium 111 can be obtained at a higher degree of accuracy.

(Printing Unit)

The carriage unit 15 having received a driving force travels in the main scan direction, and liquid is ejected from the print head 12 at a timing at which the carriage unit 15 passes above the print medium, and as a result, an image is formed on the print medium. In order for the carriage unit 15 to perform printing operations, a position detection unit for the carriage unit 15 is required. Therefore, the printing apparatus 100 includes a linear encoder 74 (see FIG. 2) on an operation area of the carriage unit 15, and the position of the carriage unit 15 in the main scan direction is detected by a linear encoder read unit provided in the carriage unit 15. The linear encoder as the position detection unit can be replaced with a rotary encoder, a stepping motor, a transparent sensor and the like as long as it has a technique of having a position detection function.

(Print Head Path Switching Apparatus)

Next, switching a path in operation of the print head 12 will be described. A main purpose of performing printing in the printing apparatus 100 is a barcode having one-inch width and the related characters. However, a printable area of the print head 12 to be used is a 0.5-inch width, and accordingly, it is required to perform the printing operation at least twice in order to perform the printing at one-inch width. Thus, a switching unit switching a path of the print head 12 in a direction orthogonal to the main scan direction during performing the printing operation is adopted in the present embodiment. This switching unit will be described below.

The printing apparatus 100 is configured such that the carriage unit 15 retains the print head unit 14 and that a pressing-contacting unit 16 of the head holder 13 is guided to a rail guide member 90 passing through a different path in a forward path and in a backward path by being pressed and contacted thereto via a pressing biasing member 17. Then, in performing the printing operation, the print head unit 14 performs scanning on a different path in the forward path and the backward path by changing a contacting portion of the pressing-contacting unit 16 in the forward path and the backward path.

Figure 8A:
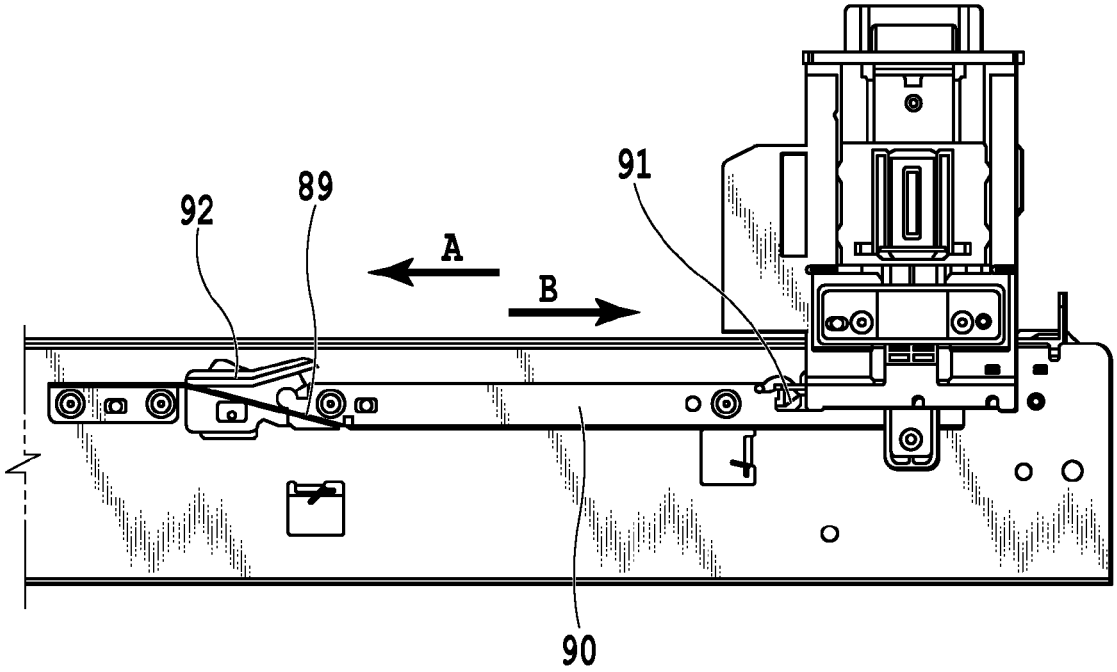
FIG. 8A is a view illustrating a print head path switching apparatus.
Figure 8B:
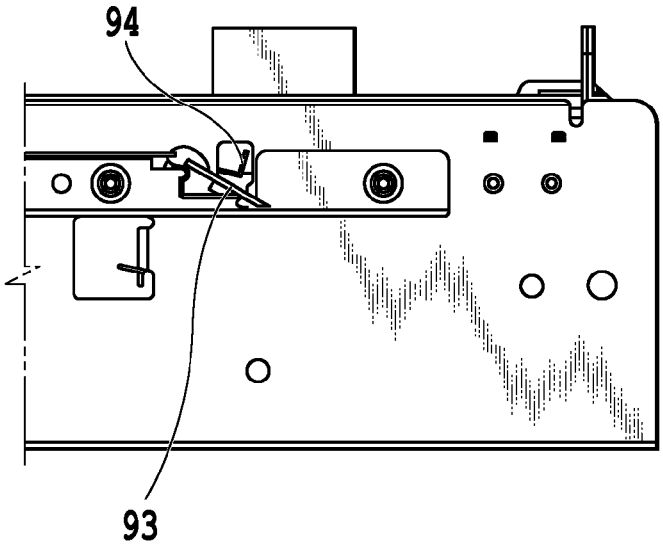
FIG. 8B is a view illustrating the print head path switching apparatus.

FIGS. 8A and 8B are views illustrating print head path switching apparatuses. Upon starting performing the printing operation, the carriage unit 15 scans a first path travelling in a direction of an arrow A to perform the printing in the forward path on a print medium. Thereafter, the carriage unit 15 arrives at an inclination unit 89 of the rail guide member 90, which is provided at the downstream side in a travelling direction of the first path and formed to be directed to a second path. During the travel of the carriage unit 15, the pressing-contacting unit 16 serving as a portion of head holder 13 is pressed in a direction orthogonal to the main scan direction with respect to the rail guide member 90, by the pressing biasing member 17 as a positioning unit of the print head unit 14. The inclination unit 89 includes a guide path switching unit 92, which is configured independently of the rail guide member 90. The guide path switching unit 92 rotates around a predetermined rotation axis, and is biased against the rail guide member 90 so as to guide the pressing-contacting unit 16 from the first path to the second path in a normal state.

Further, in the course of travelling of the head holder 13 in the inclination unit 89, the guide path switching unit 92 has a mechanism to retreat to the downstream side in the travelling direction of the print head unit 14 while making contact with the pressing-contacting unit 16. In a case where the carriage unit 15 arrives at the inclination unit 89, the pressing-contacting unit 16 travels in a direction orthogonal to the main scan direction by using the inclination of the inclination unit 89, and the print head unit 14 is accurately guided to the second path, which is a next printing area. The print head unit 14 having traveled into the second path from the first path starts to perform the printing operation in the backward path in a direction of an arrow B after the guide path switching unit 92 returns to a normal state position from the retreat position. The print head unit 14 travels in the guide path switching unit 92 (hereinafter, referred to as a "guide rail") as a portion of the second path, and performs the printing operation in the backward path to start the printing on the print medium again. A timing at which printing is started in the backward path is controlled by the position detection unit of the carriage unit 15.

The print head unit 14 having finished the printing in the backward path continues traveling along the rail guide member 90. The print head mounted on the print head unit 14 travels to a print head standby position provided on the first path in preparation for a next job, such as cleaning on a face and capping of the ejection port. Therefore, a first path guide unit 91 is provided such that the carriage unit 15 travels from the second path of the rail guide member 90 to the first path, which is an end portion of the area after printing and has a standby position on an extended line of the area. The first path guide unit 91 includes a second guide rail 93, which is a different member from the rail guide member 90, and has a function of rotating around a predetermined rotary point to guide the print head unit 14 to the first path.

Since the print head unit 14 travels while being pressed against the rail guide member 90 and the second guide rail 93, the second guide rail 93 having a rotating function rotates to the first path side while being pressed by the print head unit 14. The print head unit 14 having finished the printing operation in the backward path (second path) and passed on the second guide rail 93 travels to a standby position, and after performing the predetermined processing, the print head unit 14 travels into the first path of the rail guide member 90 again to start the printing operation in a case where the next job is input.

Here, in a case where the guide rail 92 is retained at an angle made for the first path, in performing the next job, the print head unit 14 is guided to the second path side of the rail guide member 90 at the time of performing printing in the forward path. Therefore, the second guide rail 93 needs to retreat to a position where the print head is not influenced so as to travel in the first path by the time of starting the next job. In the present embodiment, the second guide rail 93 is biased and retained by a guide rail biasing member 94 by force smaller than the pressing force of the print head unit 14, in a direction opposite to a pressing direction of the print head unit 14. This allows the second guide rail 93 to travel to the second path side of the rail guide member 90 by biasing force, while the print head unit 14 travels along the first path, that is, while not passing through the second guide rail 93. While the print head unit 14 passes above the second guide rail 93 in the backward path, the second guide rail 93 rotates at an angle to be guided to the first path by the pressing force of the print head unit 14, thereby guiding the print head unit 14 to the forward path side.

(Cleaning Mechanism of Head Face Side after Printing)

The cleaning blade 6 of the purge apparatus makes contact with a formation surface of an ejection port of the print head (ejection opening face) to wipe off residual ink after the printing, immediately before the carriage unit 15 guided to the first path returns to the standby position. Thereafter, the carriage unit 15 stops at the standby position to allow the ejection opening face to be capped with the cap 8. The printed print medium is taken out by a user, and a series of printing operations is completed.

Thus, the carriage guide surface 40 guiding the carriage traveling in the main scan direction, and the main scan direction regulating unit 64 and the sub-scan direction regulating unit 65 which determine the position of the print medium are provided on the same member. This makes it possible to achieve the carriage apparatus capable of suppressing the misalignment of the print medium 111 by a simple configuration.

Second Embodiment

Hereinafter, a second embodiment of the present invention will be described. Incidentally, a basic configuration of the present embodiment is the same as that of the first embodiment, and accordingly, only a characteristic configuration will be described below.

In the first embodiment, the carriage unit 15 and the print medium 111 are accurately positioned based on the same member, and thus it becomes possible to suppress the misalignment of the print medium 111 and perform the printing therein. However, in the first embodiment, the carriage unit 15 is not actively made to contact with the carriage guide surface 40. Further, the print medium 111 is positioned by the main scan direction regulating unit 64 and the sub-scan direction regulating unit 65, but is not actively made to contact therewith. Accordingly, misalignment may occur between the carriage unit 15 and the print medium 111 within a range of dimensional tolerance of components.

In the present embodiment, the carriage unit 15 is actively made to contact with the carriage guide surface 40, and the print medium 111 is actively made to contact with the main scan direction regulating unit 64 and the sub-scan direction regulating unit 65. Therefore, the carriage unit 15 and the print medium 111 can be more accurately positioned, and it becomes possible to achieve printing with a higher accuracy.

In order to achieve such printing, a print medium biasing unit is provided to bias the print medium 111 against the main scan direction regulating unit 64 and the sub-scan direction regulating unit 65, and further, a carriage biasing unit is provided to bias the carriage unit against the carriage guide surface 40. An elastic member, a spring, and the like are used for the print medium biasing unit and the carriage biasing unit.

In this way, the carriage unit 15 is actively made to contact with the carriage guide surface 40, and the print medium 111 is actively made to contact with the main scan direction regulating unit 64 and the sub-scan direction regulating unit 65. This makes it possible to achieve the carriage apparatus capable of suppressing the misalignment of the print medium 111 by a simple configuration.

Third Embodiment

Hereinafter, a third embodiment of the present invention will be described with reference to the drawing. Incidentally, a basic configuration of the present embodiment is the same as that of the first embodiment, and accordingly, only a characteristic configuration will be described below.

In the first and second embodiments, the printing is performed on the print medium 111 using the print head scanned in the main scan direction by the carriage apparatus. In the present embodiment, an image printed on the print medium 111 is read by a read unit mounted on the carriage apparatus. In this way, the read unit is mounted on the carriage apparatus, and the read unit reads the image on the print medium while traveling, thereby achieving reading with a high accuracy.

Figure 9:
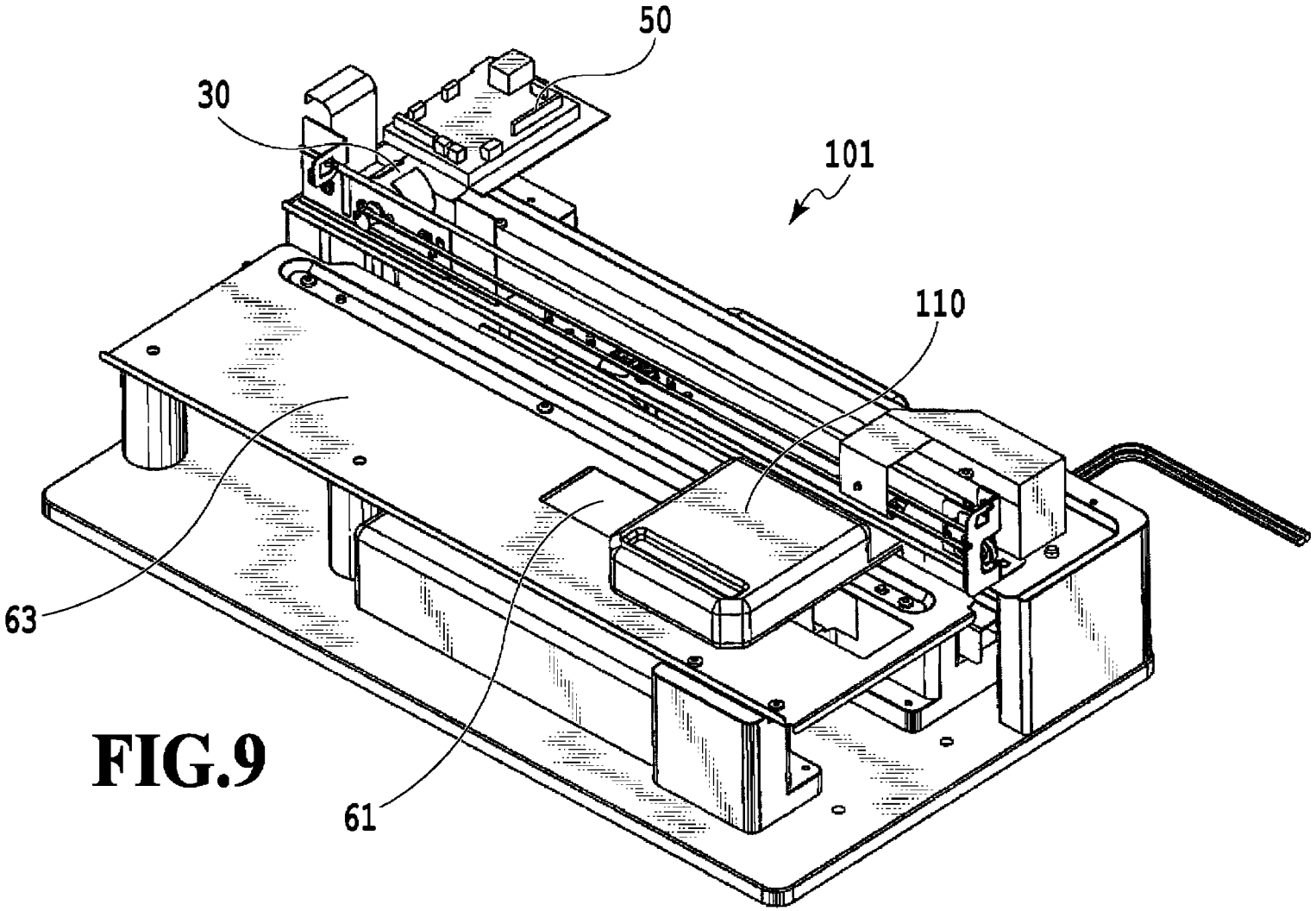
FIG. 9 is a perspective view illustrating a reading apparatus.

FIG. 9 is a perspective view illustrating a reading apparatus of the present embodiment. As shown in FIG. 9, a read unit 110 is mounted on a carriage in the present embodiment. The read unit 110 performs scanning on the print medium, thereby reading an image printed on the print medium 111 with a high accuracy.

Other Embodiment

Both of the main scan direction regulating unit and the sub-scan direction regulating unit 65 which determine the position of the print medium are provided in the above-described embodiments. However, the regulating unit may be provided only in a direction in which the position accuracy of the print medium is required.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-010176 filed Jan. 21, 2016, which is hereby incorporated by reference herein in its entirety.

What is claimed is:

1. A carriage apparatus capable of mounting a processing unit which is configured to perform predetermined processing with respect to a sheet, the apparatus comprising:

a positioning unit configured to be able to abut against an end portion of the sheet and position the sheet in a direction orthogonal to a scanning direction of the carriage, a guide unit configured to guide the carriage so as to be capable of moving forward and backward in the scanning direction of the carriage, wherein the guide unit includes a guide surface abutting on the carriage and regulating a position in a direction orthogonal to the scanning direction of the carriage, the guide surface having a surface perpendicular to a surface of the sheet positioned by the positioning unit; and a biasing unit configured to bias the carriage against the guide surface, wherein the positioning unit and the guide unit are integrally formed.

2. The carriage apparatus according to claim 1, wherein the processing unit is a print unit configured to perform printing by ejecting liquid onto the sheet.

3. The carriage apparatus according to claim 1, wherein the processing unit is a read unit configured to read an image printed on the sheet.

4. The carriage apparatus according to claim 1, wherein the guide unit is capable of moving forward and backward on different paths.

5. The carriage apparatus according to claim 1, further comprising a sheet biasing unit configured to bias the sheet with respect to the positioning unit.

6. The carriage apparatus according to claim 1, further comprising a pressing unit configured to press the sheet in a direction perpendicular to a surface of the sheet that is subjected to processing by the processing unit.

7. The carriage apparatus according to claim 1, wherein a correction unit configured to correct an inclination of the carriage is disposed in the guide unit.

8. A carriage apparatus capable of mounting a processing unit which is configured to perform predetermined processing with respect to a sheet, the apparatus comprising:

a positioning unit including an abutting portion for abutting an end portion of the sheet and positioning the sheet in a direction perpendicular to a scanning direction of the carriage; and a guide unit configured to guide the carriage so as to be capable of moving forward and backward in the scanning direction of the carriage, wherein at least a part of the guide unit is disposed vertically below the abutting portion.

* * * * *